United States Patent [19]

Gregor et al.

[11] Patent Number: 5,034,104

[45] Date of Patent: Jul. 23, 1991

[54] SERVICING AND EMPTYING APPARATUS FOR COKE-OVEN BATTERY

[75] Inventors: Karl Gregor, Bochum; Kurt Asmus, Erftstadt, both of Fed. Rep. of Germany

[73] Assignee: Gewerkschaft Schalker Eisenhutte, Gelsenkirchen, Fed. Rep. of Germany

[21] Appl. No.: 220,894

[22] Filed: Jul. 18, 1988

Related U.S. Application Data

[63] Continuation of Ser. No. 65,165, Jun. 19, 1987, abandoned, which is a continuation of Ser. No. 510,365, Jul. 1, 1983, abandoned.

[30] Foreign Application Priority Data

Jul. 6, 1982 [DE] Fed. Rep. of Germany ..... 3225149
Jul. 17, 1982 [DE] Fed. Rep. of Germany ..... 3226885

[51] Int. Cl.[5] ..... C10B 33/14

[52] U.S. Cl. ..... 202/241; 202/248; 202/263; 202/270

[58] Field of Search ..... 202/291, 248, 262, 263, 202/270

[56] References Cited

U.S. PATENT DOCUMENTS

| | | | |
|---|---|---|---|
| 3,436,316 | 4/1969 | Lorrek | 202/262 |
| 3,616,946 | 11/1971 | Linnerz et al. | 202/262 |
| 3,817,840 | 6/1974 | Stender | 202/262 |
| 3,844,900 | 10/1974 | Schulte et al. | 202/262 |
| 3,981,778 | 9/1976 | Schulte et al. | 202/263 |
| 4,003,802 | 1/1977 | Pries | 202/262 |
| 4,026,768 | 5/1977 | Bahnsch et al. | 202/262 |
| 4,153,515 | 5/1979 | Gregor et al. | 202/248 |
| 4,340,987 | 7/1982 | Gregor et al. | 202/241 |
| 4,347,105 | 8/1982 | Kwasnik et al. | 202/262 |

FOREIGN PATENT DOCUMENTS

| | | | |
|---|---|---|---|
| 736120 | 6/1943 | Fed. Rep. of Germany . | |
| 2034624 | 3/1971 | Fed. Rep. of Germany . | |
| 2426428 | 12/1975 | Fed. Rep. of Germany . | |
| 1529611 | 10/1978 | United Kingdom | 202/263 |
| 1559324 | 1/1980 | United Kingdom | 202/262 |
| 2086019 | 5/1982 | United Kingdom | 202/270 |

*Primary Examiner*—Peter Kratz
*Attorney, Agent, or Firm*—Browdy and Neimark

[57] ABSTRACT

A coking installation has a longitudinal succession of coking chambers having respective coke sides opening transversely above a bench level above ground level and an outer rail extending longitudinally along and adjacent the coke sides of the chambers. A quenching-car track extends longitudinally adjacent the coke sides between the outer rail and the chambers and a main gangway runs longitudinally at the bench level along the coke sides of the chambers between same and the quenching-car track. An inner rail extends longitudinally between the car track and the gangway and a portal support rides on and moves along the inner and outer tracks. This support carries door-removing equipment, door-cleaning equipement, doorframe-cleaning equipment, and a coke guide. A drive on the portal support displaces the equipement and guide transversely thereon between an extended position extending across the main gangway and engaging one of the coking chambers and a retracted position substantially clear of the main gangway. A quenching car is displaceable along the car track underneath the portal support to receive coke pushed from the chambers through the guide.

14 Claims, 4 Drawing Sheets

SERVICING AND EMPTYING APPARATUS FOR COKE-OVEN BATTERY

This application is a continuation of co-pending application Ser. No. 065,165 filed June 19, 1987, now abandoned, itself a continuation of application Ser. No. 510,365, filed July 1, 1983, and abandoned in favor of Ser. No. 065,165.

FIELD OF THE INVENTION

The present invention relates to a coking installation. More particularly this invention concerns an apparatus for emptying the chambers and servicing the doors and door openings thereof.

BACKGROUND OF THE INVENTION

A coking installation normally has a succession or battery of coking chambers having respective coke sides opening transversely above a bench level above ground level. A quenching-car track extends longitudinally adjacent the coke sides between the outer rail and the chambers. A quenching car is displaceable along the car track underneath the portal support to receive coke pushed from the chambers. A main gangway extends longitudinally at the bench level along the coke sides of the chambers between same and the quenching-car track. A support riding on and displaceable along its own pair of tracks carries door-removing equipment, door-cleaning equipment, doorframe-cleaning equipment, and a coke guide. These devices may have built-in or external drives.

Normally, as described in German patent document 2,426,428 filed 31 May 1974 by H. Bahnsch and H. Kwasnik, the rails for the support of all the emptying and servicing equipment are provided at the bench level on the main gangway. The quenching-car rails are at ground level so that, once the chamber door has been removed, the guide can conveniently channel a pushed-out charge of coke from the coking side of this chamber across the gangway to the quenching car or onto a ramp leading to a water-filled quenching pit.

In such an arrangement the gangway is always at least partially blocked by the support, so that other equipment employed at the gangway can only work to the side of this equipment, normally only to one longitudinal side of it. Furthermore the rails on the gangway are a bother, and building the gangway sufficiently strong to support the considerable weight of the support and the servicing and emptying equipment it caries is a considerable expense.

German patent document 2,034,624 filed by F. Neuville wit a claim to the Belgian priority of 15 July 1969 and German patent 736,120 of E. Grasshoff describe a hood which rides on rails that flank those of the quenching car. The hood is a reactively light structure which is cantilevered over the gangway to a position adjacent the sides of the chambers of the coking battery. This structure, which would be insufficient to support vy door-servicing equipment, also blocks the gangway even when not in use.

OBJECTS OF THE INVENTION

It is therefore an object of the present invention to provide an improved coke-oven servicing and emptying apparatus.

Another object is the provision of such a coke-oven servicing and emptying apparatus which overcomes the above-given disadvantages, that is which completely frees the main gangway, yet which performs all of the necessary servicing and emptying functions, to wit: taking off the chamber door and cleaning it, guiding the pushed-out coke across the gangway to the quenching car, aspirating gases released by the open chamber, cleaning the jamb or frame, and replacing the door.

SUMMARY OF THE INVENTION

A coking installation according to the invention has a longitudinal succession of coking chambers having respective coke sides opening transversely above a bench level above ground level and an outer rail extending longitudinally along and adjacent the coke sides of the chambers. A quenching-car track extends longitudinally adjacent the coke sides between the outer rail and the chambers and, as is known, a main gangway runs longitudinally at the bench level along the coke sides of the chambers between same and the quenching-car track. An inner rail extends longitudinally between the car track and the gangway and a portal support rides on and moves along the inner and outer tracks. This support carries door-removing equipment, door-cleaning equipment, doorframe-cleaning equipment, and a coke guide. A drive on the portal support displaces the equipment and guide transversely thereon between an extended position extending across the main gangway and engaging one of the coking chambers and retracted position substantially clear of the main gangway. A quenching car is displaceable along the car track underneath the portal support to receive coke pushed from the chambers through the guide.

The portal support of this invention is heavily constructed and capable of supporting all the servicing and emptying equipment. In addition the apparatus according to the instant invention can move completely out of the gangway, allowing full access to any coke chamber at any time one of the chambers is not being pushed or serviced by the apparatus.

The apparatus of this invention also has a gas-collecting hood supported on the support over the quenching car and means for aspirating gases released from the coke sides of the chambers between same and the portal support through the hood. The hood is transversely displaceable between the extended and retracted positions also and is formed by a part fixed on the portal support and a movable part displaceable relative to the fixed part transversely between the positions. The movable hood part and coke guide and/or the equipment are fixed together for joint transverse displacement. This ensures automatic and complete exhausting of any vapors released when a coking chamber is pushed.

The portal according to the instant invention has an outer leg engaging downward on the outer rail. In addition a second outer rail is provided generally above the first-mentioned outer rail. The outer leg has a roller upwardly engageable with the second rail. Thus tipping of the portal support toward the chambers is impeded by the second rail Such tipping is a possibility when the machine is extremely heavily laded.

More particularly and in accordance with another invention feature, the portal support has outer leg structure riding on the outer rail, inner leg structure riding on the inner rail, and stage structure extending horizontally between the leg structures above the quenching car. The stage is provided with horizontally and longitudinally extending rails on which rides a frame carrying the guide and equipment.

In addition the portal support has respective pairs of horizontally and transversely extending equipment rails supporting the respective equipment for transverse movement on the support.

According to this invention one of the inner and outer rails is generally at the ground level and one is generally at the bench level. The inner rail can be at the ground level or at the bench level. The outer rail is generally elevated generally to the bench level, to keep itself clear of the coke dust.

What is more, the door-removing and -cleaning devices each have a slide displaceable on the respective equipment rails and an outrigger pivotal about an upright axis. Thus, for instance, the door-removing grab can be moved forward into engagement with a door to be pulled and back to retract the door, and then pivoted to juxtapose the removed door with a cleaner as described in K. Gregor et al U.S. patent application Ser. No. 172,267 filed July 25, 1980, now U.S. Pat. No. 4,321,957.

The support can also be provided with equipment for opening and closing a cover on the quenching car. Thus once the car is full, its cover can be dropped back down so it can move out from underneath the exhaust hood without leaking pollution.

DESCRIPTION OF THE DRAWING

The above and other features and advantages will become readily apparent from the following, reference being made to the accompanying drawing in which.

SPECIFIC DESCRIPTION

Figure 1:
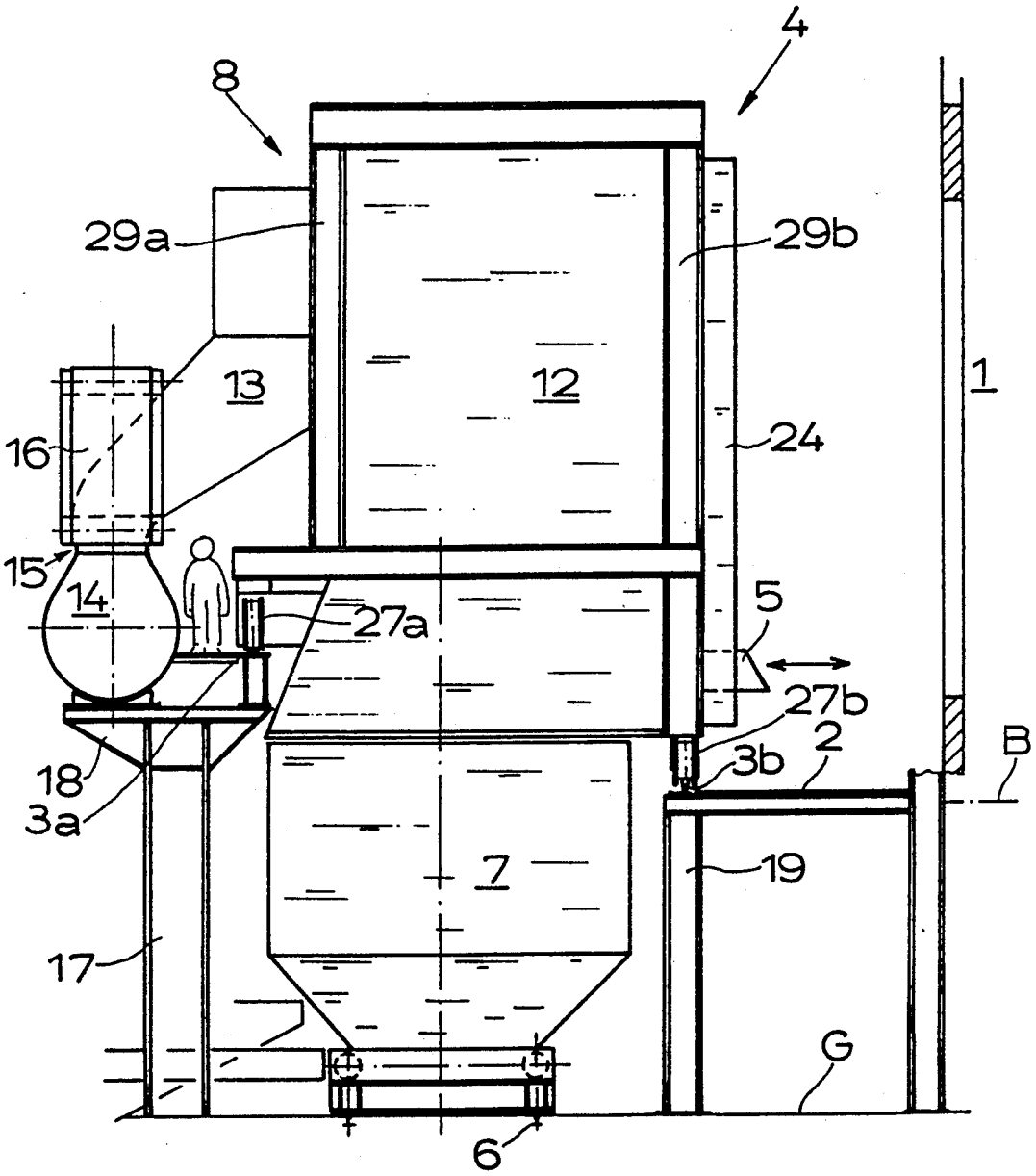
FIG. 1 is an end view partly in section of the installation according to this invention.
Figure 3:
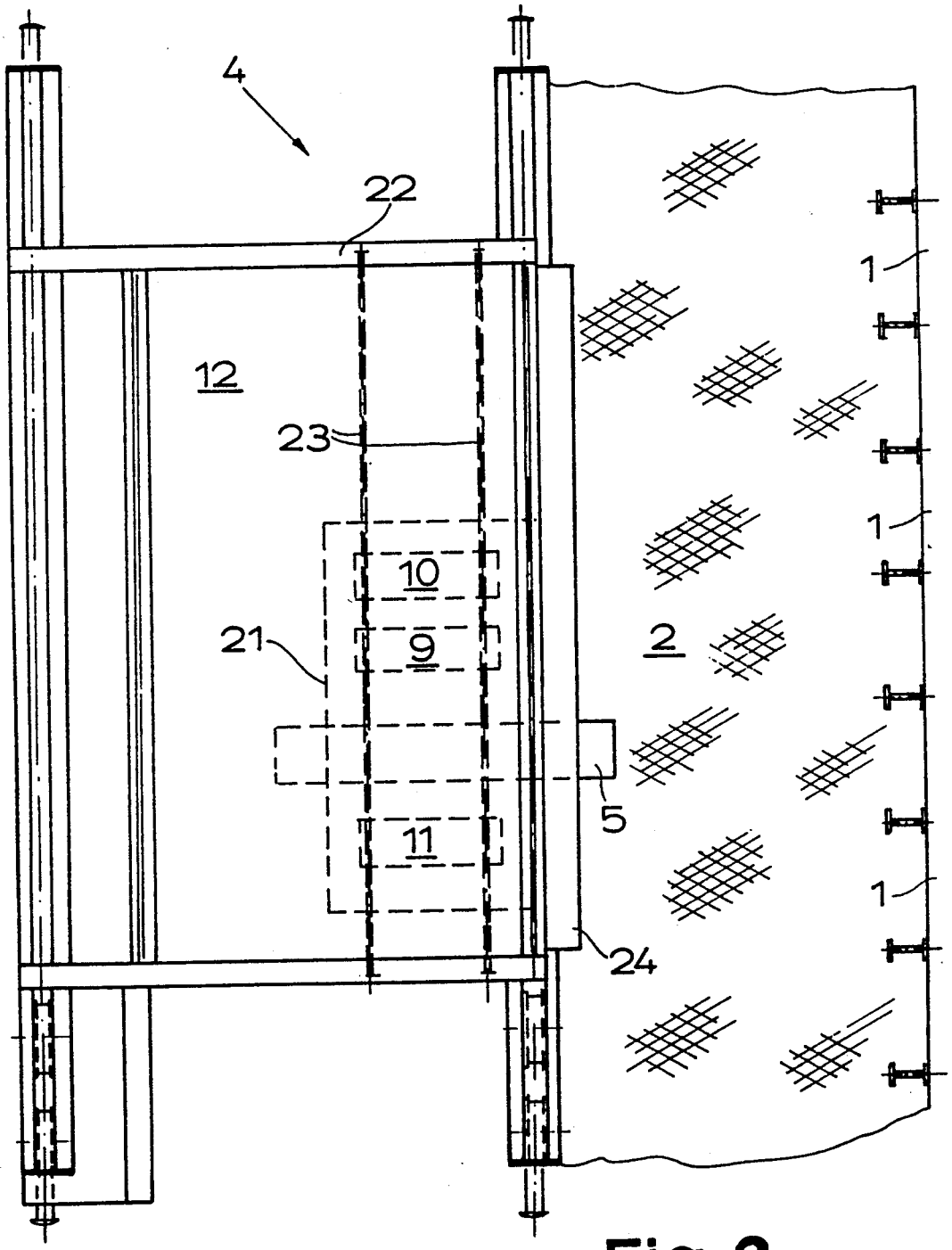
FIG. 3 is a top view of the installation of FIG. 1.

As seen in FIGS. 1 and 3 a battery of coking chambers 1 opens at a bench level B defined by a horizontal and longitudinally extending gangway 2 used by service people and their equipment for repair and testing of the installation. Removable doors 31 (FIG. 4) normally close these sides of the chambers 1. As is well known in the art and not illustrated here, a pusher on the opposite side of the chambers 1 can push the coke therefrom.

A servicing and emptying apparatus 4 carries a tubular guide 5 engageable over and to both longitudinal sides of an open coke chamber 1 to funnel the coke pushed from the other side down into a standard quenching car 7 supported on rails 6 provided at the round level G below the level B and extending longitudinally parallel to the battery of chambers 1.

A gas-aspirating device 8 generally of the type described in copending patent application Ser. No. 172,267 filed July 25, 1980 (now U.S. Pat. No. 4,321,957) serves to exhaust gases from the working location. It has a stationary hood part 12 and a movable hood part 24 which can swing out to cover the entire area from one longitudinal end of the apparatus 4 to the other.

Figure 4:
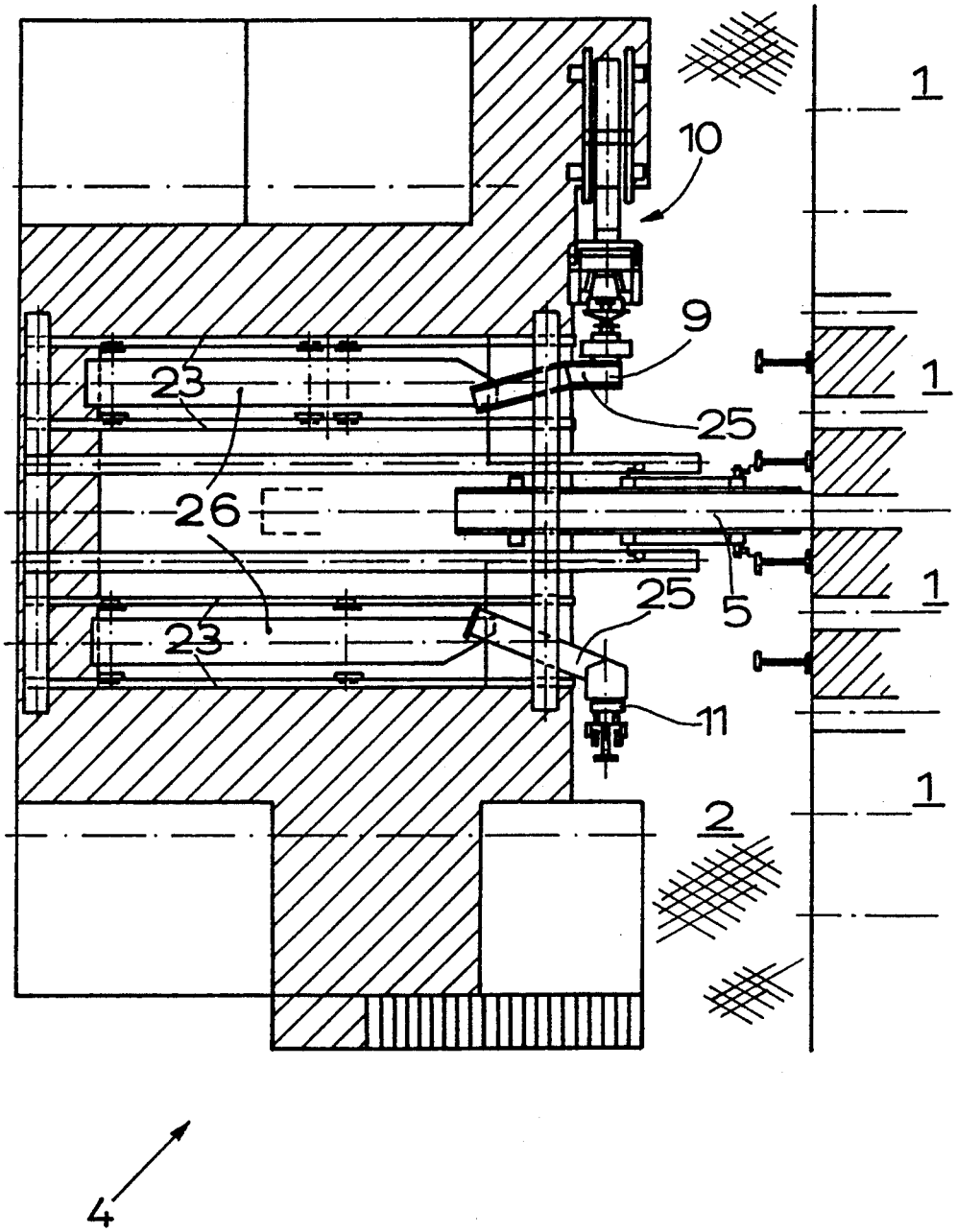
FIG. 4 is a large-scale and partly sectional top view of a detail of FIG. 3.

In addition, noting FIGS. 3 and 4, the apparatus 4 carries a door-opening device 9, a door-cleaning device 10, and a door-frame cleaner 11.

The exhaust device 8 has a duct 13 that opens into the fixed hood part 12 and that is connected at 15 to a stationary conduit 14 by a traveling-car arrangement 16 that operates in the manner described in the first above-mentioned patent application. Thus all gas rising in the work site will be effectively aspirated and transmitted to a treatment plant.

The device 4 has a frame having an outer leg **29*a* supported via rollers or wheels 27*a* on an outer rail 3*a* and inner leg structure 29*b* supported viz similar wheels 27*b* on an inner rail 3*b*. The rails 3*a* and 3*b* flank the rails 6 so that the car 7 can move longitudinally independently of the apparatus 4**.

The outer rail **3*a* is carried on the upper end of a frame having outer columns 17 that also support an outrigger 18 carrying the exhaust duct 14 at bench level B. The rail 3*a*** is also at bench level B to avoid fouling it excessively with coke dust.

Figure 2:
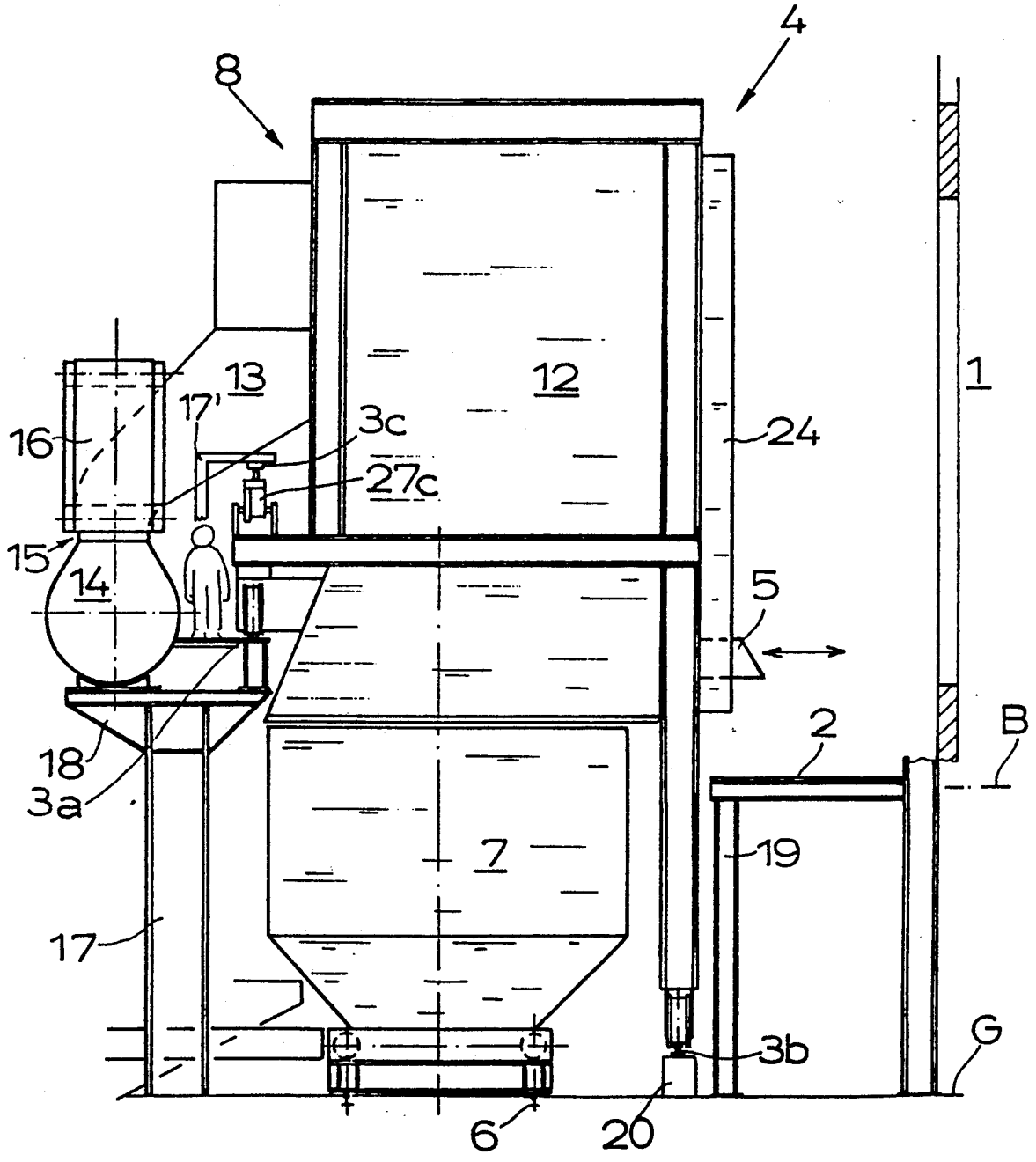
FIG. 2 is a view like FIG. 1 of another installation according to the present invention.

The inner rail **3*b* can sit as shown in FIG. 1 on the outer edge of the gangway 2 which is supported by inner columns 19. It an also be provided slightly outward of the gangway 2 and at ground level G as shown in FIG. 2, supported on a footing 20. In addition as shown in FIG. 2 further wheels 27*c* can engage a third rail 3*c* supported by an upper framework 17' so that tipping of the entire apparatus 4** about a horizontal and longitudinal axis to the left is impossible.

In addition and as better seen in FIG. 3 the leg structures **29*a* and 29*b* are rigidly interconnected at their upper end by a horizontal platform or stage 22 provided with two small longitudinally extending service rails 28 from which is suspended a frame or carriage 21 carrying the elements 5 and 9–11. Furthermore each of the service devices 9 and 11 has its own frame or slide 26 displaceable transversely in the frame 21 in respective pairs of rails 23. Each device 9 and 11 has an outrigger arm 25** pivotal about a respective vertical axis.

The system according to this invention therefore allows several chambers 1 to be emptied without moving the apparatus 4 or car 7, working from top to bottom as seen in FIG. 3.

When a batch of several chambers 1 are to be pushed, the entire apparatus 4 is positioned so the opener 9 is directly transversely across from the first of the three chambers, 1 to be emptied, with the second chamber aligned with the guide 5 and the third with the cleaner 11. The movable hood part 24 is pivoted down to cover over the entire area above and somewhat to the two sides of the chambers being pushed and aspiration is started, so any gases released are trapped for treatment.

Then the opener 9 extends to grab the door 31 and release its latches, then it retracts and pivots to hold the door 31 so the cleaner 10 can work on it as is well known in the art. Meanwhile the slide 21 is pulled one step to the side and the guide 5 is extended from the retracted position of FIG. 3 to the extended position of FIG. 4 so it can fit in and around the chamber 1 that was just opened. The coke can then be pushed from this chamber 1 to slide across and down in the guide 5, landing in the quenching car 7.

Once this operation is complete, and as it occurs all gases are effectively trapped, the guide 5 is retracted and the frame 21 is moved another step in the same longitudinal direction to bring the frame cleaner 11 into position. It is extended and moved up and down and from side to side to remove deposits from the doorjamb. A clean jamb is necessary for a good seal, which can be created as described in W. Fingerhut U.S. patent application Ser. No. 425,669, filed Sep. 28, 1982.

Once the doorjamb is clean the device 11 is retracted and the frame 21 is displaced two steps in the opposite direction so the device 9 can replace the door. The entire cycle is then repeated with the next chamber.

This system therefore can automatically perform all functions necessary to recover coke from a coking battery. It aspirates all gases that are generated and can work batchwise. At the same time it can be pulled back to leave the gangway 2 totally free. Even between consecutive operations of one cycle it can be pulled back to allow a worker with test or repair equipment past on the gangway 2. The batch-type operation minimizes the amount of times the entire apparatus 4 must be stepped, thereby further simplifying operation.

We claim:

1. A coking installation comprising:

a longitudinal succession of coking chambers having respective coke sides opening transversely above a bench level above ground level;

an outer rail extending longitudinally along and adjacent the coke sides of the chambers;

a quenching-car track extending longitudinally adjacent the coke sides between the outer rail and the chambers;

a main gangway extending longitudinally at the bench level along the coke sides of the chambers between same and the quenching-car track;

an inner rail extending longitudinally between the car track and the gangway and immediately adjacent the gangway, the main gangway lying substantially wholly between the inner rail and the coke sides of the chambers;

a portal support riding on and displaceable along the inner and outer rails above the quenching-car track without substantially overlaying said gangway and carrying a door-removing equipment, a door-cleaning equipment, a doorframe-cleaning equipment, and a coke guide;

means on the portal support for displacing the door-removing equipment and the doorframe-cleaning equipment and guide transversely thereon between an extended position extending horizontally and transversely from the support across the main gangway and engaging one of the coking chambers and a retracted position substantially clear of the main gangway;

a quenching car displaceable along the car track underneath the portal support to receive coke pushed from the chambers through the guide;

a gas-collecting hood supported on the support over the quenching car; and means for aspirating gases released from the coke sides of the chambers between same and the portal support through the hood, the hood being transversely displaceable between the extended and retracted positions also, wherein the hood comprises a part fixed on the portal support and a movable part displaceable relative to the fixed part transversely between the positions, wherein the movable hood part and the coke guide are fixed together for a joint transverse displacement, and wherein the door-removing equipment and the doorframe-cleaning equipment each include a slide transversely displaceable on the support and a head pivotal on the respective slide about a vertical axis.

2. The coking installation defined in claim 1 wherein the movable hood part, coke guide, and equipment are fixed together for joint displacement.

3. The coking installation defined in claim 1 wherein the portal support has an outer leg engaging downward on the outer rail, the installation further comprising a second outer rail generally above the first-mentioned outer rail, the outer leg having a roller upwardly engageable with the second rail, whereby tipping of the portal support toward the chambers is impeded by the second rail.

4. The coking installation defined in claim 1 wherein the portal support has:

outer leg structure riding on the outer rail;

inner leg structure riding on the inner rail; and stage structure extending horizontally between the leg structures above the quenching car.

5. The coking installation defined in claim 4 wherein the stage structure is provided with horizontally and longitudinally extending support rails the installation further comprising a frame riding on the support rails and carrying the guide and equipment.

6. The coking installation defined in claim 4 wherein one of the inner and outer rails is generally at the ground level.

7. The coking installation defined in claim 4 wherein one of the inner and outer rails is generally at the bench level.

8. The coking installation define in claim 4 wherein the inner rail is generally at the ground level.

9. The coking installation defined in claim 4 wherein the inner rail is generally at the bench level.

10. The coking installation defined in claim 1 characterized in that the portal support has respective pairs of horizontally and transversely extending equipment rails supporting the respective equipment for transverse movement on the support.

11. A coking installation according to claim 1 wherein said outer rail is located above the level of said inner rail, said inner rail being located directed above and supported by inner columns and said outer rail being supported by outer columns, said outer columns further supporting a stationary conduit (14) for cooperation with said means for aspirating gases, a walkway space being provided between said outer rail (3*a*) and said stationary conduit (14).

12. A coke-oven with a plurality of horizontal coking chambers and a main gangway extending in front of the coking chambers in the direction of length of the coke-oven, with two lengths of rail extending in the direction of length of the coke-oven, with a coke transfer machine traversable along the lengths of rail in front of the coking chambers carrying a coke-mass guideway with auxiliary equipment including a door-lifting appliance, a door-cleaning appliance, a doorframe cleaning appliance, and with a coke-quenching car traversable on the other lengths of rail parallel to the coke transfer machine, in which the length of rail for the coke transfer machine that is more remote from the coking chambers is situated at the side of the coke-quenching car that faces away from the coking chambers and the length of rail for the coke transfer machine that is nearer to the coking chambers is situated at or directly in front of the edge of the main gangway that faces the coke quenching car, the coke transfer machine is provided as a portal frame construction bridging over the coke quenching car but essentially leaving the main gangway unencumbered and exposed, and the coke-mass guideway and the auxiliary equipment of the coke transfer machine are each extendable over the main gangway up to the appropriate coking chamber, wherein a movable collection equipment (8) is provided to collect the dust-laden gasses that are released when the coke is pushed, the collection equipment (8) possesses a collector hood (12) solidly mounted on the coke transfer machine (4) and bridging over the coke transfer machine (4) and the coke-quenching car (7), the collector hood (12) possess an additional hood (24) that is extendable over the main gangway (2) up to the coking chambers (1) and the additional hood (24) together with the coke-mass guideway (5) and together with the auxiliary equipment is traversable transversely to the direction of traverse of the coke transfer machine (4).

13. Apparatus according to claim 12 further comprising track means (28) for supporting said auxiliary equipment and for permitting said auxiliary equipment to move parallel to said main gangway relative to said movable collection equipment (8).

14. Apparatus according to claim 13 further comprising a plurality of transversely extending trackways (23) supported by said movable collection equipment (8) on which the auxiliary equipment is traversable transversely to the direction of traverse of the coke transfer machine.

* * * * *